US006343695B1

(12) United States Patent
Petrick et al.

(10) Patent No.: US 6,343,695 B1
(45) Date of Patent: Feb. 5, 2002

(54) LABELED MEDICAL CONTAINER ASSEMBLY

(75) Inventors: Kathryn D. Petrick, Minneapolis, MN (US); Matthew A. Kramer, Fairport, NY (US); Richard L. Moor, Angola, IN (US)

(73) Assignee: Moore North America, Inc.

( * ) Notice: Subject to any disclaimer, the term of this patent is extended or adjusted under 35 U.S.C. 154(b) by 436 days.

(21) Appl. No.: 09/206,253

(22) Filed: Sep. 23, 1998

Related U.S. Application Data

(62) Division of application No. 08/864,739, filed on May 28, 1997, now Pat. No. 5,976,014.

(51) Int. Cl.[7] ..... B65D 83/04

(52) U.S. Cl. ..... 206/534; 206/807; 283/81

(58) Field of Search ..... 206/528, 534, 206/807, 459.5, 540; 283/81; 40/310–313, 638; 229/102; 383/5; 215/230, 201

(56) References Cited

U.S. PATENT DOCUMENTS

| | | | | |
|---|---|---|---|---|
| 1,588,964 A | | 6/1926 | Hutchins | |
| 3,625,547 A | | 12/1971 | Burke | |
| 3,674,286 A | | 7/1972 | Dodgson | |
| 4,029,341 A | | 6/1977 | Neill et al. | |
| 4,277,089 A | | 7/1981 | Lockhart | |
| 4,455,182 A | | 6/1984 | Roth et al. | |
| 4,799,712 A | | 1/1989 | Biava et al. | |
| 4,873,193 A | | 10/1989 | Jensen et al. | |
| 4,905,829 A | * | 3/1990 | Stribiak | 206/807 |
| 4,944,603 A | * | 7/1990 | Cornish et al. | 383/5 |
| 5,011,559 A | | 4/1991 | Felix | |
| 5,098,130 A | * | 3/1992 | Mikhail | 283/81 |
| 5,178,419 A | | 1/1993 | Bolnick et al. | |
| 5,195,123 A | | 3/1993 | Clement | |
| 5,225,162 A | | 7/1993 | Scoville | |
| 5,328,208 A | | 7/1994 | Garrison | |
| 5,346,739 A | | 9/1994 | Nassoiy | |
| 5,411,295 A | | 5/1995 | Bates et al. | |
| 5,495,944 A | | 3/1996 | Lermer | |
| 5,507,429 A | * | 4/1996 | Arlin | 206/807 |
| 5,601,314 A | | 2/1997 | Burns et al. | |
| 5,605,230 A | * | 2/1997 | Marino, Jr. et al. | 206/534 |
| 5,645,300 A | * | 7/1997 | Hill | 283/81 |
| 5,866,183 A | * | 2/1999 | Small | 206/807 |

* cited by examiner

*Primary Examiner*—L. K. Bui
(74) *Attorney, Agent, or Firm*—Nixon & Vanderhye PC

(57) ABSTRACT

A business form has a first paper portion with multiple plies and a second portion which is a release liner and has a number of distinct labels disposed on it. At least one of the labels is dimensioned and configured to hold a removable cap on a medical container to indicate if the container cap has been tampered with, and preferably that label has a length of between about 10–11 inches so that it can be wrapped completely around a 90 ml plastic specimen vial, or other medical container, so that portions of the label are in contact with each other, enhancing the tamper evident functionality of the label. A second label on the release liner may be a box seal, and other labels may be provided to facilitate tamper evident functionality of the form.

18 Claims, 6 Drawing Sheets

Fig. 2A
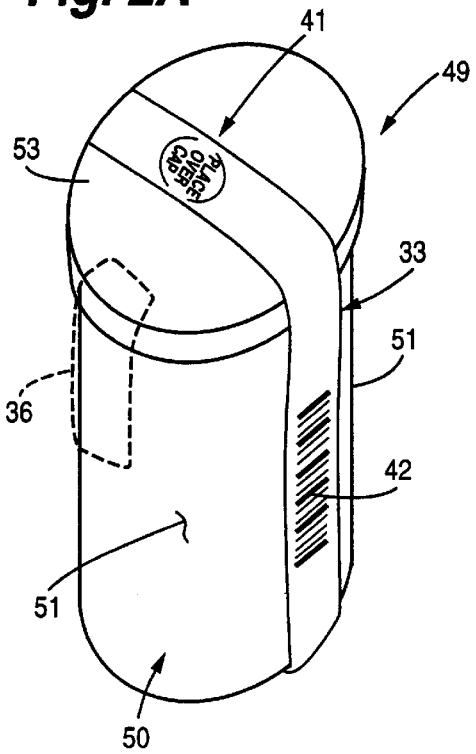
Fig. 2B
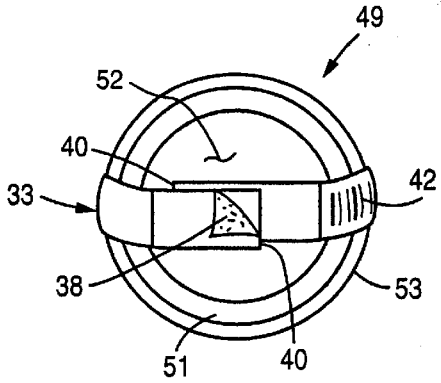
Fig. 3
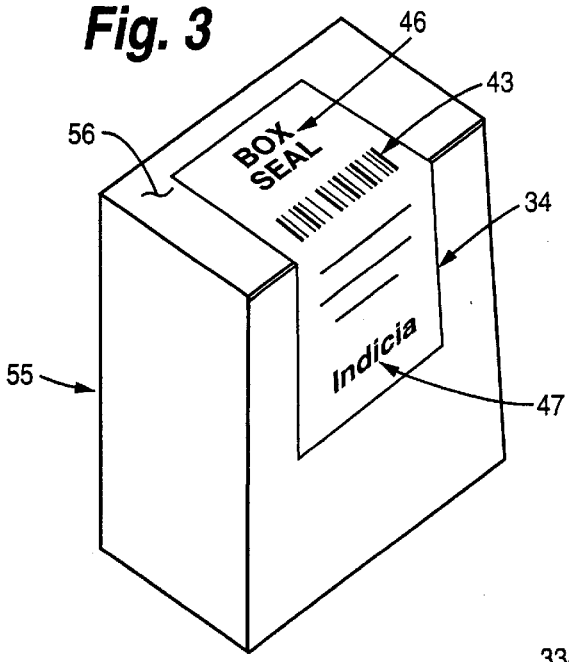
Fig. 8
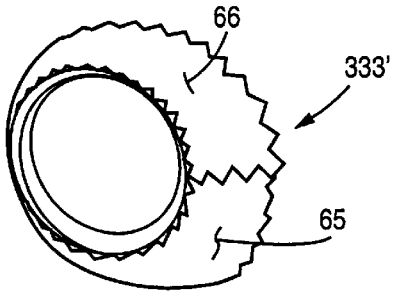
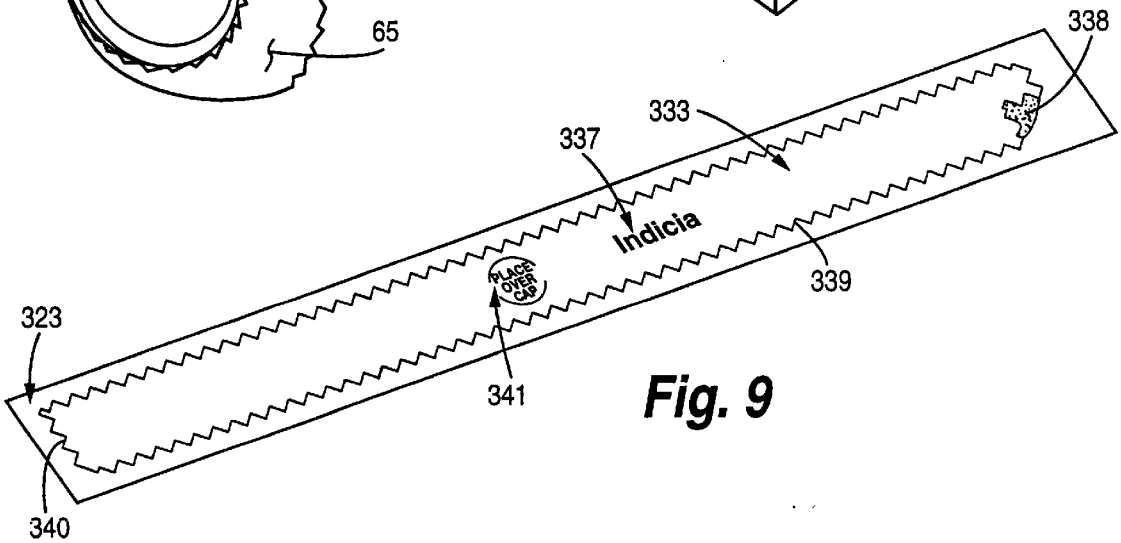
Fig. 9

LABELED MEDICAL CONTAINER ASSEMBLY

This application is a Div. of Ser. No. 08/864,739 filed May 28, 1997, now U.S. Pat. No. 5,976,014.

BACKGROUND AND SUMMARY OF THE INVENTION

In the manufacture and utilization of business forms for a wide variety of medical containers it is necessary to use some sort of tamper evident feature. Particularly in association with business forms that are used in drug testing or other specimen collection where the integrity of the specimen collected, or integrity of other contents of a container, is necessary, a wide variety of tamper evident techniques are utilized. Some exemplary techniques for this purpose are seen in U.S. Pat. Nos. 4,873,193, 5,411,295, and 5,495,944. The most common commercial systems utilize a tamper evident label having a length such that it engages one side wall, the removable cap, and the opposite side wall of a medical container (such as a specimen vial, bottle, or the like). The label stock used is typically a paper base face stock with an aggressive adhesive, such as available from Fasson. While these labels can be very worthwhile, under some conditions a very careful person intent on tampering might be able to remove the label from one side of the container without tearing the label by pulling the adhesive away from the side wall of the container.

When providing business forms for medical purposes, it is desirable to provide a number of different labels which can provide a variety of different functions, with the same form. For example one or more labels may be provided to allow one or more specimen vials to be sealed in a tamper evident manner, while at the same time a label is provided to seal a box in which the vial may be transported. Other labels may facilitate tamper evident functions by being placed on other portions of the vial to be sealed, or to provide bar coding or other indicia useful for some purpose associated with the provision of the labels.

According to the invention a business form is provided that is ideally suited for use in recording information about, and appropriately labeling, medical containers, such as drug testing specimen vials, and associated procedures, dispensing of pharmaceutical substances, or the like. The business forms according to the present invention are highly convenient, versatile, and effective in providing a variety of functions.

The invention also relates to a particular label configuration, and a combination of label with medical container, that are advantageous compared to the art. According to the invention a full wrap label is provided for a container which has enhanced tamper evident functionality because the label material is brought into actual contact with label material, making it more difficult to tamper with the container without being noticed.

According to one aspect of the present invention a business form is provided comprising the following components: A first, multiple ply, paper form portion having form entry indicia thereon, parallel top and bottom edges, and first and second side edges perpendicular to the top and bottom edges. Image transfer means associated with the multiple plies to transfer indicia impact imaged on one ply to at least one other ply. A second release liner form portion attached to one edge of at least one ply of the first form portion. At least three distinct labels disposed on the second form portion, each label having top and bottom surfaces, pressure sensitive adhesive on the bottom surface thereof, which adhesive engages the release liner second form portion, and indicia on the top surface thereof. A first of the distinct labels being dimensioned and configured to hold a removable cap on a medical container to indicate if the container cap has been tampered with, and wherein the pressure sensitive adhesive on the bottom surface thereof is permanent adhesive. And, a second of the distinct labels being dimensioned and configured to seal a box for containing a medical container, and having indicia on the top surface thereof indicating use of the label for sealing a box, and wherein the pressure sensitive adhesive on the bottom surface thereof is permanent adhesive.

The indicia on the top surface of the first label may comprise substantially centrally located indicia indicating that the indicia is to be placed on the removable cap of a medical container, such as a specimen vial, pharmaceutical substance containing bottle, or the like. A machine readable indicia on and common to at least the first and second labels may also be provided. There may also be a third distinct label substantially the same as the first label, although perhaps of a different length.

The business form may also have a second ply of paper connected to and underlying the second business form portion, with image transfer means associated with the second ply to transfer indicia impact imaged on at least one of the labels on the release liner to the second ply. This image transfer means—as well as the image transfer means associated with the multiple plies of the first portion of the form—may comprise conventional self-contained coatings, or cooperating CF/CB coatings, carbon paper, or any other conventional mechanism for relatively easily and inexpensively transferring an image from one ply to another.

The second business form portion may be connected to the second side edge of the first business form portion substantially along the entire length thereof. Tractor drive holes may be provided in the first and second portions along the first side edge of the first portion, and along an edge of the second portion most remote from and parallel to the first side edge of the first portion.

The first label may have a length sufficient to wrap completely around the removable cap and the bottom of a medical container so that one portion of the first label is affixed to another portion of the first label when the substantially centrally located indicia is over the removable cap of the medical container. For example when designed to be used with a 90 ml plastic (e.g. polypropylene) conventional specimen vial, the first label may have a length of between about 10–11 inches, typically about 10.5 inches, and a width of less than two inches, typically about ⅞ inch. The first label may have serrated side edges, as is known per se for specimen labels, and serrated end edges. Also conventional interlocking circle tamper evident features may be provided to facilitate the irremovability of the first label, and such features may also be provided in the box seal for the same purpose. Interlocking die cut circles are known in tamper evident labels per se, and they may be of conventional construction.

According to another aspect of the present invention a business form is provided comprising the following components: A first, multiple ply, paper form portion having form entry indicia thereon, parallel top and bottom edges, and first and second side edges perpendicular to the top and bottom edges. Image transfer means associated with the multiple plies to transfer indicia impact imaged on one ply to at least one other ply. A second release liner form portion attached to one edge of at least one ply of the first form portion. At least two distinct labels disposed on the second form portion, each label having top and bottom surfaces, pressure sensitive adhesive on the bottom surface thereof, which adhesive engages the release liner second form portion, and indicia on the top surface thereof. A first of the distinct labels being dimensioned and configured to hold a removable cap on a medical container to indicate if the container cap has been tampered with, and wherein the pressure sensitive adhesive on the bottom surface thereof is permanent adhesive. And, wherein the indicia on the top surface of the first label comprises substantially centrally located indicia indicating that the indicia is to be placed on the removable cap of a medical container. The details of the various components of the form, particularly the first label, may be as described above.

The invention also relates to a container assembly per se. The container assembly according to the invention comprises the following components: A medical container having a plastic or glass body with closed sides and a closed bottom and an open top, and a removable cap closing the open top. A first label having a top surface with indicia thereon and a bottom surface with permanent pressure sensitive adhesive thereon. And, the label wrapped completely around the medical container contacting the removable cap, at least a portion of the sides, and the bottom thereof, and the pressure sensitive adhesive of a portion of the first label engaging the top surface of another portion of the first label.

The first label used in the container assembly may be the label specifically as described above in association with a business form according to the invention. Wherein the container is a 90 ml plastic specimen vial, or the equivalent, the first label typically has a length of between about 10–11 inches, e.g. about 10.5 inches, and a width of less than two inches, e.g. about ⅞ inch. The invention is also useful with other conventional medical containers, such as 60 ml plastic specimen containers, pharmaceutical substance (e.g. pill) containing bottles, or the like, and the label will be dimensioned and configured so as to be appropriately useful with a given container and having the enhanced tamper evident functionality provided according to the invention.

The container assembly may also comprise at least a second label, having a length much shorter than the first label (e.g. only about 2–5 inches) and permanent pressure sensitive adhesive, the second label adhesive engaging the cap and a side of the medical container.

The invention also relates to a label per se for which in providing tamper evident sealing of a medical container. The label may be lined that is having a release liner associated therewith—or linerless—that is with a release coat on the top face thereof (which containers the indicia) and wrapped up in a spiral configuration, or provided in a roll. The label may be in a kit as the only component of the kit or one of several components of the kit, for performing any particular desired function, such as maintaining the integrity of specimens collected for drug testing. The label typically comprises: A paper or plastic substrate having a top surface and a bottom surface, first and second serrated side edges having a length of between about 10–11 inches, and end edges having a length of less than two inches. Substantially centrally located indicia on the top surface indicating that the indicia is to be placed on a removable cap of a medical container. And, permanent pressure sensitive adhesive on the bottom surface.

The invention also relates to a method of using the label as described above with a medical container having an open top covered by a removable cap, and a closed bottom and sides. The method comprises the steps of: (a) placing the adhesive of the label on the removable cap so that the substantially centrally located indicia overlies the cap; (b) wrapping the label around the container so that some of the pressure sensitive adhesive engages the sides and bottom of the container; and (c) bringing a portion of the label pressure sensitive adhesive into contact with the top surface of another portion of the label at or adjacent the container bottom.

It is the primary object of the present invention to provide an advantageous business form, container assembly, label for use in providing tamper evident sealing of the medical container, and a method of use of such a label. This and other objects of the invention will become clear from an inspection of the detailed description of the invention and from the appended claims.

BRIEF DESCRIPTION OF THE DRAWINGS

FIGS. 2A and 2B are top perspective and bottom plan views, respectively, of a container assembly according to the present invention, which includes a tamper evident label from the business form of FIG. 1;

FIG. 3 is a top perspective view of a box with a box seal label associated therewith, the label from the business form of FIG. 1;

FIG. 8 atop perspective view of an exemplary label per se according to the Present invention; and FIG. 9 is a top perspective view of a linerless version of the label of FIG. 8, according to the invention.

DETAILED DESCRIPTION OF THE DRAWINGS

Figure 1:
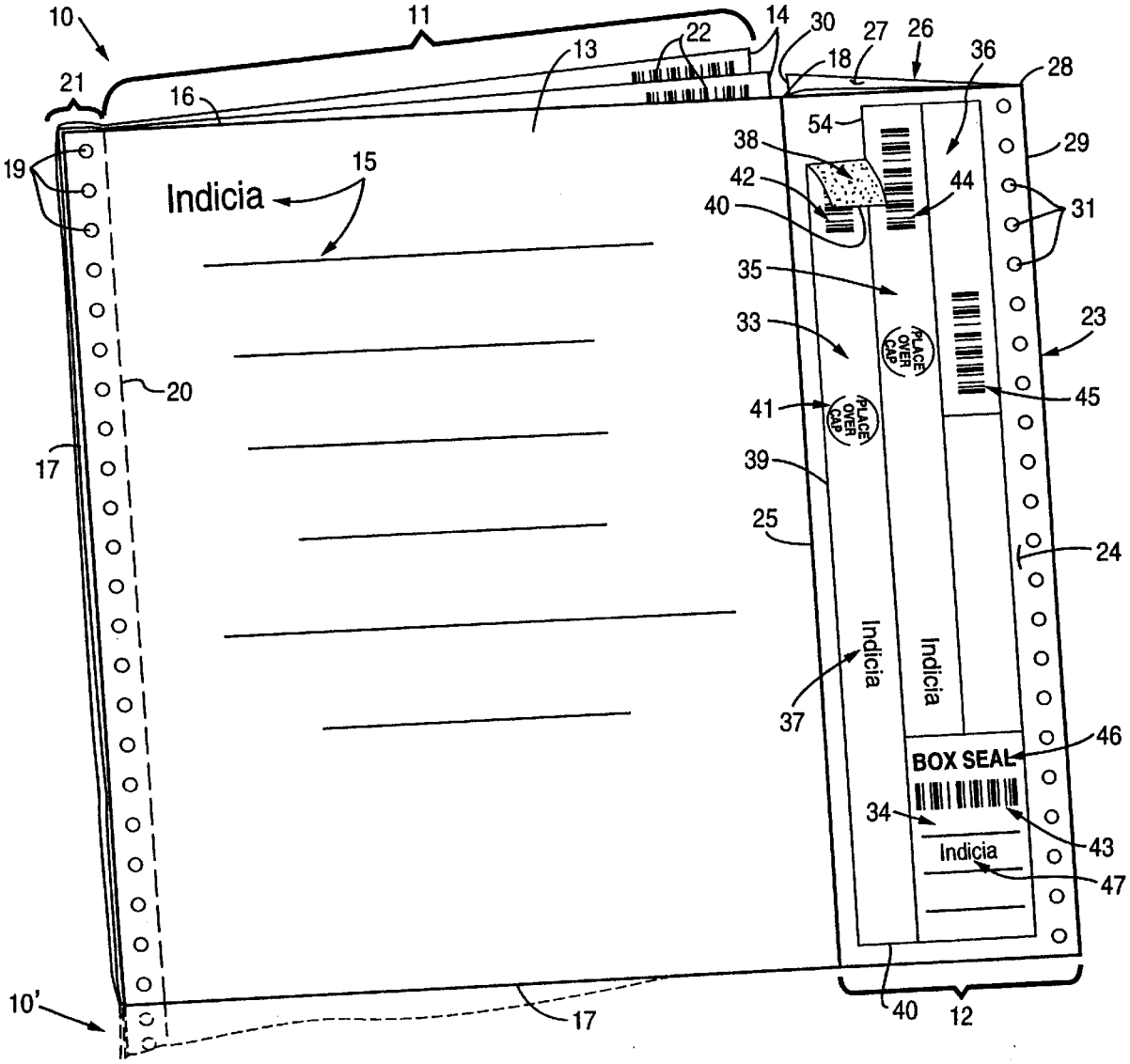
FIG. 1 a top perspective view of one exemplary configuration of a business form according to the present invention.

FIG. 1 is a perspective view of an exemplary business form 10 according to the present invention. The form 10 includes a first, multiple ply, paper form portion 11, and a second release liner form portion 12. The first portion 11 includes a top paper ply 13 and at least one additional paper ply 14, typically three or four plies. The plies 13, 14 have form entry indicia thereon, illustrated schematically at 15 in FIG. 1, parallel top and bottom edges 16, 17, respectively, and first and second side edges 17, 18, which are perpendicular to the edges 16, 17. Typically the plies 13, 14 are fastened together by adhesive along the first edge 17 thereof, and tractor drive openings 19 may be provided along the edge 17, and a line of weakness 20 (such as a perforation line) provided to allow detachment of the plies 13, 14 from each other and from the margin portion 21 which contains the adhesive and the tractor drive openings 19.

The first form portion 11 has image transfer means associated therewith. The image transfer means may take a wide variety of forms such as self-contained carbonless coatings, cooperating CF/CB coatings, carbon paper, or the like, comprising virtually any conventional mechanism that allows relatively simple and inexpensive transfer of indicia imaged on one ply to at least one underlying ply. In the embodiment illustrated in FIG. 1 the image transfer means is shown schematically by carbonless self-contained coatings 22 provided on the top face of each of the plies 14.

The second form portion 12 has a substrate 23 which is a release liner, that is typically made of a material that has a silicone or like adhesive release coating on the top face 24 thereof. While the exact positioning of the second form portion 12 may vary depending upon the particular desires of the consumer of the form 10, in the embodiment illustrated in FIG. 1 the release liner 23 is connected along an edge 25 thereof to the second side edge 18 of just the top ply 13 of the first form portion 11. The connection along the edges 18, 25 may be any suitable conventional connection, such as an adhesive, a splicing material, interlocking fibers, etc.

In the embodiment illustrated in FIG. 1 the portion 12 also has a second ply 26, and an image transfer means—such as the schematically illustrated self-contained coating 27 on the top surface of the paper second ply 26—may be provided for transferring images impacted on the release liner 23 (or the labels thereon as will be more fully described hereafter) to the paper ply 26. The paper ply 26 may be connected along the remote edge 28 thereof, aligned with the remote edge 29 of the release liner 23, by adhesive or the like, and/or the near edge 30 thereof may be connected to one of the cooperating edges of the plies 14. Tractor drive holes 31, comparable to the holes 17, may be provided adjacent the edges 28, 29 in the release liner material 23 and the paper underlying ply 26.

Of course the form 10 may be one of a continuous web of forms, either in roll configuration or fanfolded, with each form 10 connected to others along the edges 16, 17, which may be perforation lines or other lines of weakness. A like continuous form to which it could be connected is illustrated schematically and in dotted line at 10' in FIG. 1.

Mounted on the release coated surface 24 of the release liner 23 are a plurality of distinct labels. Preferably at least a first label 33, a second label 34, and a third label 35 are provided, but a number of other labels may also be provided such as the label 36. Each of the labels has a top surface on which indicia is imaged and a bottom surface having pressure sensitive adhesive, preferably permanent pressure sensitive adhesive for most if not all of the labels 33–36. For example the indicia imaged on the top surface is illustrated schematically at 37 for the first label 33, while the pressure sensitive adhesive on the bottom surface thereof is shown at 38 near the top of the label 33 where it is shown being pulled away from the release liner 23. In the embodiment illustrated in FIG. 1 the first label 33 is a full wrap label for a medical container, such as a specimen vial, as will be explained hereafter, having a length (that is the dimension of the edge 39 thereof of between 10–11 inches (e.g. about 10.5 inches) when designed to be used with a conventional 90 ml polypropylene specimen vial, and having a width (dimension of the edge 40 thereof) of less than two inches, e.g. about ⅞ inch.

In addition to the general indicia 37 illustrated, the label 33 preferably also has substantially centrally located indicia, illustrated schematically at 41 in FIG. 1 but seen more clearly in other figures, which indicates that the indicia is to be placed on the removable cap of a medical container (e.g. reading "Place Over Cap"). Also machine readable indicia—such as the bar coding 42—is preferably provided on the top surface of the label 33 which may be common indicia with other bar coding 43, 44, 45 associated with one or more of the other labels 34 through 36, respectively, and/or the form portion 10.

The second label 34 has indicia 46 on the top surface thereof indicating use of the label 34 for sealing a box. In the embodiment illustrated in FIG. 1 this indicia 46 is the words "Box Seal". Other indicia, shown schematically at 47, is also typically provided on the top surface of the second label 34.

The third label 35 is substantially the same as the first label 33, only it has a different length. For example it may have the length for complete wrap around of a 60 ml polypropylene specimen vial, or it may be a less than complete wrap around label for a 90 ml specimen vial. The label 36 has a length much less than that of the label 33.

FIGS. 2A and 2B show the use of the first label 33 in association with a conventional medical container, shown schematically at 49 in FIGS. 2A and 2B. The medical container 49 illustrated is a conventional 90 ml plastic specimen vial having a body—shown schematically at 50—with closed sides 51, a closed bottom 52 (see FIG. 2B) and an open top covered by a removable cap 53. The container 49 is per se entirely conventional.

The label 33 has a length such that it is a complete wrap around label with respect to the container 49. With a substantially centrally located indicia 41 overlying the cap 53, the permanent pressure sensitive adhesive 38 on the bottom surface of the label 33 engages the top of the cap 53, portions of the sides 51, and portions of the bottom 52 of the container 49. The adhesive 38 preferably is a conventional aggressive adhesive, such as used with the conventional Fasson material with a paper based face stock and an aggressive adhesive conventionally used in tamper evident labels. Because of the length of the label 33 with respect to perimeter of the container 49, the edges 40 overlap (see FIG. 2B) so that adhesive 38 of one portion of the label 33 (adjacent the one edge 40, for example) engages the top surface of another portion of the a label 33 (adjacent the other edge 40, as seen in FIG. 2B). The adhesive 38 engaging another part of the label material makes the label 33 much more difficult to remove without illustrating that it has been tampered with, then if the label 33 did not completely wrap around the container 49.

FIG. 2A shows a fourth label 36 also associated with the container 49 to provide further tamper evident functionality, the label 36 adhesive engaging the top surface of the removable cap 53 and a portion of the side 51 of the body 50 of the container 49.

FIG. 3 illustrates the use of the box seal label 34 in association with a conventional cardboard box 55 which, for example, may be dimensioned so as to receive one or two specimen vials—such as the specimen vial shown at 49 in FIGS. 2A and 2B—therein. The top of box 45 is formed by a conventional removable flap 56, and the flap 56 is sealed to the rest of the box 5 by the box label 34, the permanent pressure sensitive adhesive associated therewith engaging the removable flap 56 and at least one side of the box 55 to hold the flap 56 in the closed position illustrated in FIG. 3 in a tamper-evident manner.

Figure 4:
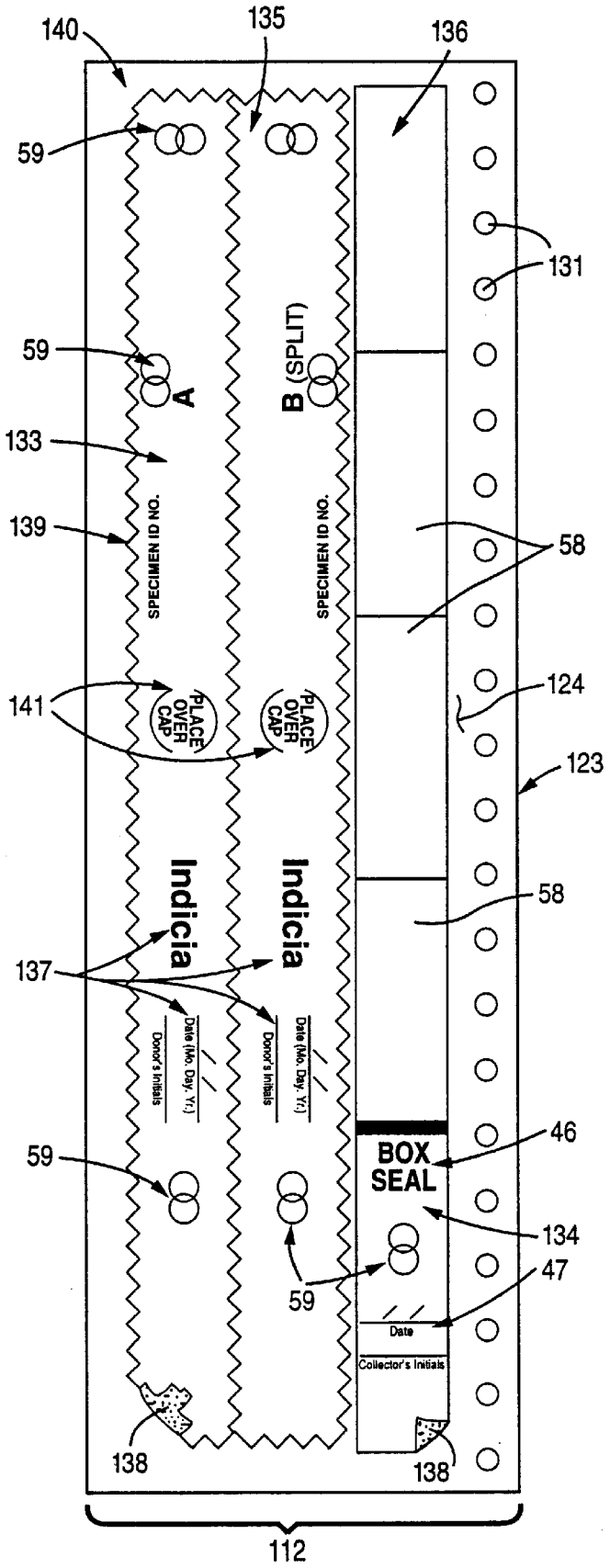
FIG. 4 is a top plan view of another configuration of the second portion of the business form of FIG. 1, and particular the labels utilized therewith.

FIG. 4 illustrates another embodiment of just the second form portion 111 of a business form according to the present invention. In FIG. 4 components comparable to those in the FIG. 1 embodiment are shown by the same reference numeral only preceded by a "1".

In the embodiment of FIG. 4, the release liner 123 has seven labels associated therewith, the first through fourth labels 133 through 136, and other labels 58. Label 133 is essentially identical to the label 33 illustrated in the FIG. 1 embodiment, including having a length of about 10.5 inches, except that the side edges 139 thereof are serrated (as is conventional per se), as are the end edges 140.

Also in this embodiment the label 133 is provided with conventional interlocking circles 59 which are adapted to detach from the rest of the label 133 after application to a container 49 to make tampering more difficult.

In the embodiment of FIG. 4 the third label 135 has substantially the same length, configuration, and features as the label 133, so that the labels 133, 135 may be used with specimen containers of the same size, or the like. The box seal 134 has different dimensions than the box seal 34 but otherwise contains the same features, and has the permanent aggressive pressure sensitive adhesive 138 just like the label 133, and also has a conventional interlocking circles tamper evident feature 59.

Figure 5:
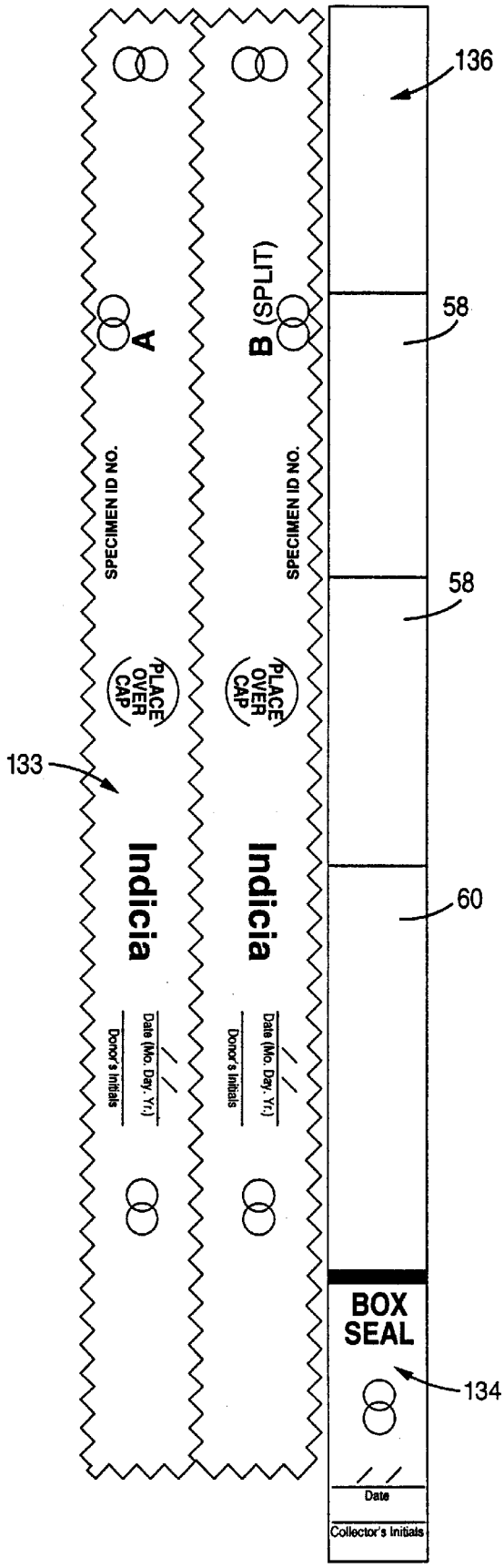
FIGS. 5 through 7 are top plan views, with the release liner removed for simplicity of illustration, of alternative label configurations to that of FIG. 4 for a business form according to the invention.

In the embodiment of FIG. 5 all of the components are identical to those in the FIG. 4 except that one of the labels 60 is longer than the other labels 58, 136.

Figure 6:
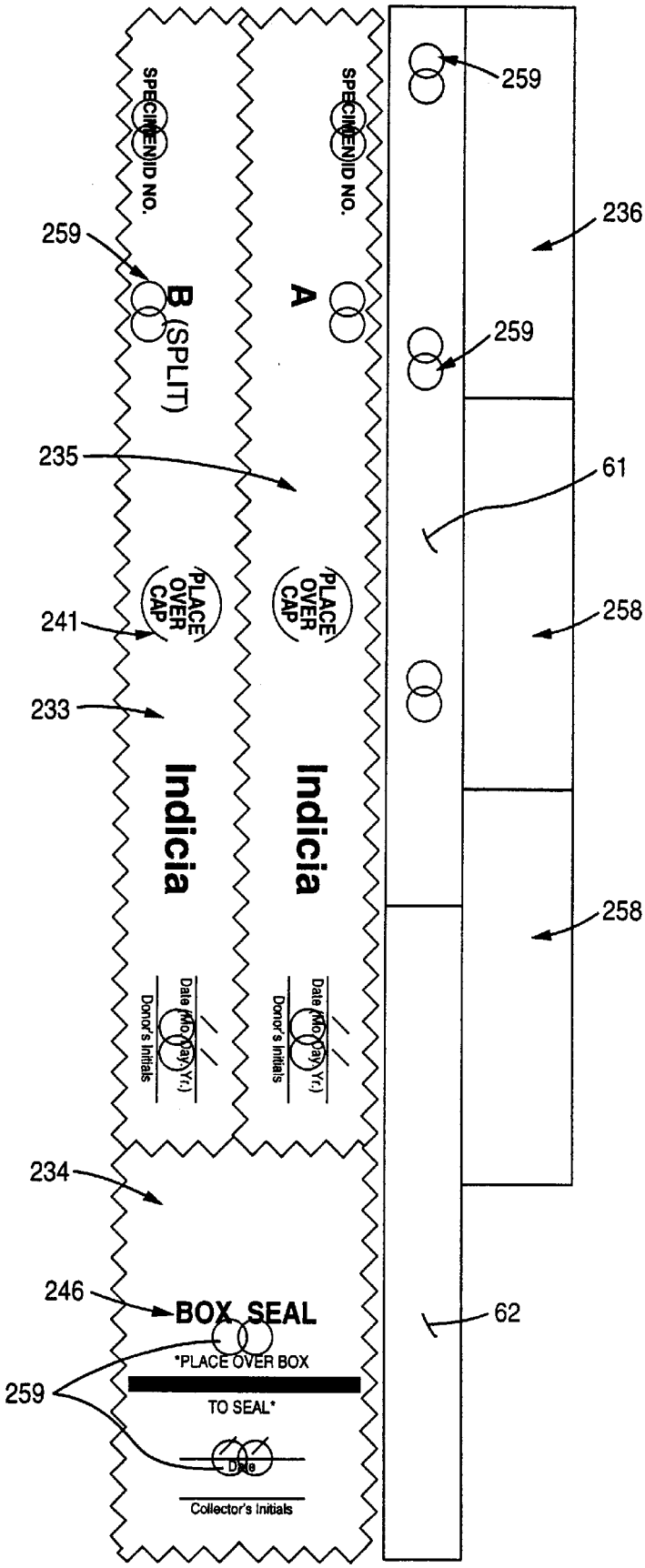

In FIG. 6 the components comparable to those in the FIGS. 1 and 4 embodiments are shown by the same two digit reference numeral only preceded by a "2". In this embodiment the labels 233, 235 are only partial wrap labels for a 90 ml specimen vial, e.g. having a length between about six to eight inches, while the box seal 234 has a length of about three to four inches. The edges of the box seal 234 are also serrated. Here the accessory labels 61, 62 are provided, the labels 61 having a tamper evident interlocking circle feature 259 therein. The label 61 is designed to be wrapped around the circumference of the body 50 of the container 49, the interlocking circles 259 providing a tamper evident function, and the length of the label 61 is such that one end may overlap the other so that adhesive engages the label. Also the label 61 may be either wrapped around the label 33 as seen in FIG. 2A, or—less desirably—placed in direct contact with the side walls 51 of the container 49.

Figure 7:
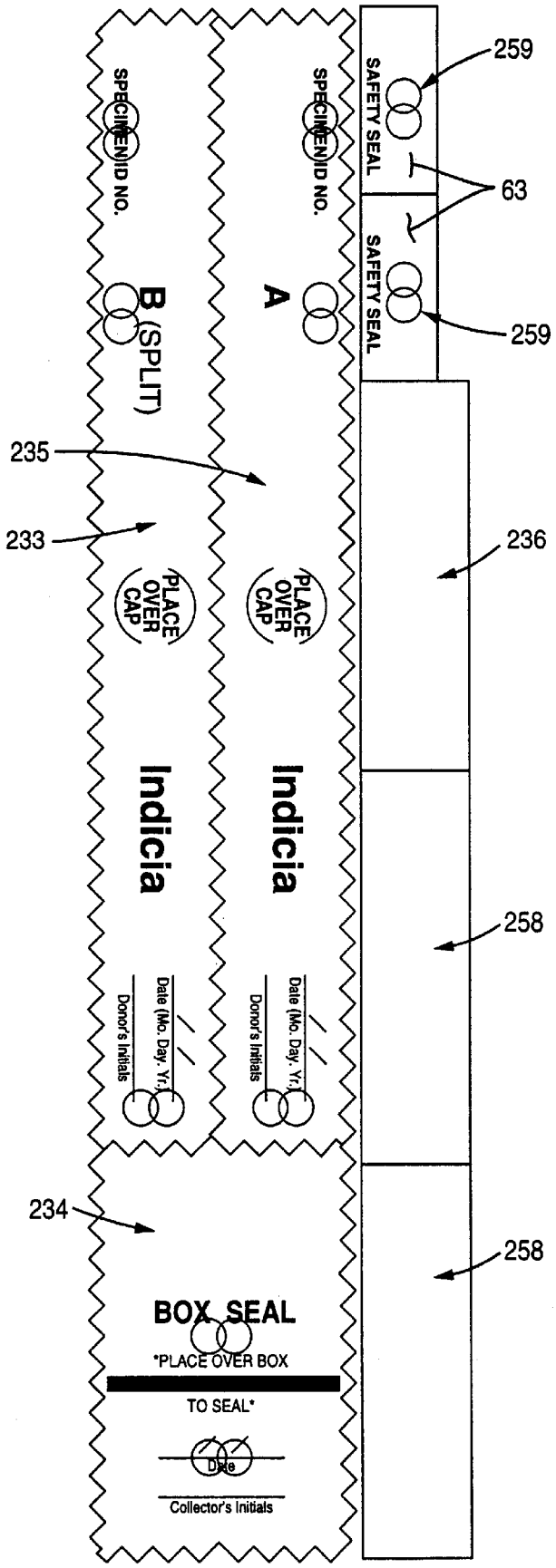

The embodiment of FIG. 7 is similar to that of FIG. 6 only instead of a full circumference security seal label 61 safety seal security tab labels 63 are provided. The security tab labels 63 have the interlocking circle tamper evident feature 259 and may be used either on the ends of the label 233, 235, or like the label 36 shown in dotted line in FIG. 2A.

FIG. 8 illustrates a tamper evident label per se according to the invention, in a lined label format. In FIG. 8 components comparable to those in the FIG. 1 embodiment are shown by the same two digit reference numeral only preceded by a "3". In this case a single label 333, preferably having a length of between about 10–11 inches (e.g. about 10.5 inches) and a width of less than two inches (preferably about ⅞ inch) with serrated edges 339, 340 is mounted on a strip of release liner 323 and is provided in a kit form. The permanent pressure sensitive adhesive 338 readily releases from the release liner 323.

FIG. 9 shows a label like the label 333, indicated generally by reference numeral 333', except that instead of being a lined label it is a linerless label. The only difference between the label 333 and the label 333' is that the top surface (such as containing the indicia 341, 337) 65 of the label 333' has adhesive release material so that it can be curled up in a spiral as illustrated in FIG. 9 and provided in that form in a kit, etc.

Either of the labels 333, 333'—just like the labels 33, 133, 233—may be used in association with a medical container having an open top covered by a removable cap 53 by placing the adhesive 338 on the removable cap 53 so that the substantially centrally located indicia 341 overlies the cap 53 (see FIG. 2A illustrating the label 33 for that use), wrapping the label 333 around the container 49 so that some of the pressure sensitive adhesive engages the sides 51 and bottom 52 of the container 49, and bringing a portion of the label pressure sensitive adhesive 338 into contact with the top surface 65 of another portion of the label at or adjacent the container bottom. For the FIG. 9 embodiment the end of the label 333' indicated by the reference numeral 66 would not be coated with adhesive release material, for this purpose.

It will thus be seen that according to the present invention an advantageous business form, container assembly, a label for use in providing tamper evident sealing of a medical container, and a method of using the label, have been provided. While the invention has been herein shown and described in what is presently conceived to be the most practical and preferred embodiment it will be apparent to those of ordinary skill in the art that many modifications may be made thereof within the scope of the invention, which scope is to be accorded the broadest interpretation of the appended claims so as to encompass all equivalent structures, methods, and products.

What is claimed is:

1. A container assembly comprising:

a medical container having a plastic or glass body with closed sides and a closed bottom and an open top, and a removable and replaceable cap closing said open top;

a first label having a top surface with indicia thereon and a bottom surface with permanent pressure sensitive adhesive thereon; and said label wrapped completely around said medical container contacting said removable and replaceable cap, at least a portion of said sides, and said bottom thereof, and the pressure sensitive adhesive of a portion of said first label engaging the top surface of another portion of said first label, wherein said indicia on said top surface of said first label comprises substantially centrally located indicia indicating that said indicia is to be placed on said removable cap of said medical container.

2. A container assembly as recited in claim 1 wherein said first label has serrated side edges extending along the length thereof.

3. A container assembly as recited in claim 1 wherein said first label has a length of between about 10–11 inches, and wherein said container is a 90 ml plastic specimen vial.

4. A container assembly as recited in claim 2 wherein said first label has a length of between about 10–11 inches, and wherein said container is a 90 ml plastic specimen vial.

5. A container assembly as recited in claim 2 further comprising at least a second label, having a length much shorter than said first label, and permanent pressure sensitive adhesive, said second label adhesive engaging said cap and a side of said medical container.

6. A container assembly as recited in claim 1 further comprising at least a second label, having a length much shorter than said first label, and permanent pressure sensitive adhesive, said second label adhesive engaging said cap and a side of said medical container.

7. A container assembly as recited in claim 1 wherein said medical container and said removable cap are both substantially cylindrical.

8. A container assembly as recited in claim 7 wherein said pressure sensitive adhesive of a portion of said first label engages the top surface of another portion of said first label at or adjacent the bottom of said medical container.

9. A container assembly as recited in claim 1 wherein said container has a medical specimen or a pharmaceutical substance therein.

10. A container assembly as recited in claim 8 wherein said container has a medical specimen or a pharmaceutical substance therein.

11. A container assembly comprising:

a medical container having a plastic or glass body with closed sides and a closed bottom and an open top, and a removable and replaceable cap closing said open top;

a first label having a top surface with indicia thereon and a bottom surface with permanent pressure sensitive adhesive thereon; and said label wrapped completely around said medical container contacting said removable and replaceable cap, at least a portion of said sides, and said bottom thereof, and the pressure sensitive adhesive of a portion of said first label engaging the top surface of another portion of said first label, and further comprising at least a second label, having a length much shorter than said first label, and permanent pressure sensitive adhesive, said second label adhesive engaging said cap and a side of said medical container.

12. A container assembly as recited in claim 11 wherein said indicia on said top surface of said first label comprises substantially centrally located indicia indicating that said indicia is to be placed on said removable cap of said medical container.

13. A container assembly as recited in claim 12 wherein said first label has a length of between about 10–11 inches, and wherein said container is a 90 ml plastic specimen vial.

14. A container assembly as recited in claim 11 wherein said medical container and said removable cap are both substantially cylindrical.

15. A container assembly as recited in claim 14 wherein said pressure sensitive adhesive of a portion of said first label engages the top surface of another portion of said first label at or adjacent the bottom of said medical container.

16. A container assembly as recited in claim 11 wherein said pressure sensitive adhesive of a portion of said first label engages the top surface of another portion of said first label at or adjacent the bottom of said medical container.

17. A container assembly comprising:

a medical container having a plastic or glass body with closed sides and a closed bottom and an open top, and a removable and replaceable cap closing said open top;

a first label having a top surface with indicia thereon and a bottom surface with permanent pressure sensitive adhesive thereon; and said label wrapped completely around said medical container contacting said removable and replaceable cap, at least a portion of said sides, and said bottom thereof, and the pressure sensitive adhesive of a portion of said first label engaging the top surface of another portion of said first label, wherein said first label has a length of between about 10–11 inches, and wherein said container is a 90 ml plastic specimen vial, and further comprising at least a second label, having a length much shorter than said first label, and permanent pressure sensitive adhesive, said second label adhesive engaging said cap and a side of said medical container.

18. A container assembly comprising:

a medical container having a plastic or glass body with closed sides and a closed bottom and an open top, and a removable and replaceable cap closing said open top;

a first label having a top surface with indicia thereon and a bottom surface with permanent pressure sensitive adhesive thereon; and said label wrapped completely around said medical container contacting said removable and replaceable cap, at least a portion of said sides, and said bottom thereof, and the pressure sensitive adhesive of a portion of said first label engaging the top surface of another portion of said first label, wherein said pressure sensitive adhesive of a portion of said first label engages the top surface of another portion of said first label at or adjacent the bottom of said medical container.

* * * * *